US010292458B2

(12) United States Patent
Ito et al.

(10) Patent No.: US 10,292,458 B2
(45) Date of Patent: May 21, 2019

(54) BUCKLE

(71) Applicant: YKK Corporation, Tokyo (JP)

(72) Inventors: Naoyuki Ito, Toyama (JP); Hitoshi Kaneko, Toyama (JP)

(73) Assignee: YKK Corporation (JP)

( * ) Notice: Subject to any disclaimer, the term of this patent is extended or adjusted under 35 U.S.C. 154(b) by 79 days.

(21) Appl. No.: 15/592,466

(22) Filed: May 11, 2017

(65) Prior Publication Data

US 2017/0347755 A1 Dec. 7, 2017

(30) Foreign Application Priority Data

Jun. 2, 2016 (JP) ..... 2016-111286

(51) Int. Cl.
*A44B 11/26* (2006.01)

(52) U.S. Cl.
CPC ..... *A44B 11/26* (2013.01)

(58) Field of Classification Search
CPC . A44B 11/26; A44B 11/263; Y10T 24/45524; Y10T 24/45529
See application file for complete search history.

(56) References Cited

U.S. PATENT DOCUMENTS 5,584,105 A * 12/1996 Krauss ..... A44B 11/263 24/200
2013/0091671 A1 4/2013 Nishida et al.

FOREIGN PATENT DOCUMENTS

JP 5552534 B2 5/2014

* cited by examiner

*Primary Examiner* — Robert Sandy
(74) *Attorney, Agent, or Firm* — Kilpatrick Townsend & Stockton LLP

(57) ABSTRACT

A buckle includes a female part having a housing and an engaging portion provided at an inner surface of the housing, and a male part including a base and an inserted portion to be inserted into the housing of the female part. The inserted portion includes a base end coupled to the base, a free end opposite to the base end, and an engaged portion to be engaged with the engaging portion. When a force is applied to the male part for pulling the male part out of the housing, the engaged portion has a contact surface that is in contact with the engaging portion. Relative to a first center point at the center of the base end in the thickness direction of the inserted portion, a second center point at the center of the contact surface in the thickness direction is positioned downward.

7 Claims, 13 Drawing Sheets

BUCKLE

CROSS-REFERENCE TO RELATED APPLICATION

The present application claims priority of Japanese Patent Application No. 2016-111286, filed on Jun. 2, 2016 and entitled "BUCKLE", the entire contents of which are hereby incorporated by reference.

TECHNICAL FIELD

The present disclosure relates to a buckle.

BACKGROUND

A patent document 1 (Japanese Patent No. 5552534) discloses a flat-type buckle. In the buckle disclosed in this document, a leg (12) of a plug (10) is pivotable in the thickness direction of a socket (20) at the inside of the socket (20). An engaging portion (14) provided at the tip of the leg (12) engages with the engaged portion (24) at the socket (20). For releasing the engagement between the engaging portion (14) and the engaged portion (24), the socket (20) has a manipulation portion (27A) which is pivotable in the thickness direction of the socket (20). As described at paragraph 0019 of the same document, the leg (12) slants to be closer to the side of the manipulation portion (27A) along the insertion direction of the plug (10) into the socket (20). Accordingly, slight bending of the manipulation portion (27A) causes the leg (12) to pivot downward.

SUMMARY

Even in the case of patent document 1, a coupling strength of the buckle may be secured to some extent, but such coupling strength may not be sufficient in some cases. Increasing the thickness dimension for enhancing the coupling strength may be considered first, but this may go against an object of thinning of buckle, thus not easily adoptable. Thus, it may be desirable to enhance the coupling strength of buckle without greatly deteriorating a thinness of buckle.

The coupling strength may be equal to a value of force required to separate the coupled male and female parts of a buckle when stepwise increasing force is applied to the coupled male and female parts. Measurement of the coupling strength may be performed as follows: pulling belts in opposite direction which are respectively attached to the coupled male and female parts; increasing the force for pulling; and measuring the value of the pulling force when the male and female parts are separated.

A buckle according to an aspect of the present disclosure may include:

a female part including a housing and an engaging portion provided at an inner surface of the housing;

a male part including a base and an inserted portion to be inserted into the housing of the female part, the inserted portion including a base end coupled to the base, a free end opposite to the base end, and an engaged portion to be engaged with the engaging portion, wherein the inserted portion, while having a thickness, extends from the base end to the free end, and is elastically pivotable around the base end as a pivot center to allow engagement and disengagement of the engaging and engaged portions, wherein when a force is applied to the male part for pulling the male part out of the housing, the engaged portion has a contact surface that is in planar contact with the engaging portion, wherein provided that downward indicates a direction along movement of the inserted portion from its initial posture toward its deformed posture during the engagement and disengagement of the engaging and engaged portions and upward indicates a direction along movement of the inserted portion recovering from the deformed posture toward the initial posture, (i) relative to a first center point at the center of the base end in a thickness direction of the inserted portion, a second center point at the center of the contact surface in said thickness direction is positioned downward; or (ii) relative to an uppermost position at a lower surface of the base end, a position at a lower end of the contact surface is positioned downward.

In some embodiments, the lower surface of the base end of the inserted portion may be provided with a groove.

In some embodiments, a depth of the groove may be equal to or less than a value calculated by multiplying (the maximum thickness of a middle portion between the base end and the free end of the inserted portion) and (5%).

In some embodiments, the engaged portion may be projected in a width direction of the inserted portion which is perpendicular to an insertion direction of the inserted portion into the housing and the thickness direction of the inserted portion, and wherein a non-contact surface may be provided between an upper surface and the contact surface of the engaged portion, the non-contact surface being not in contact with the engaging portion when the engaging and engaged portions are engaged.

In some cases, the non-contact surface may have a round rim between the upper surface and the contact surface of the engaged portion.

In some embodiments, the female part may include a manipulation portion for releasing the engagement between the engaging and engaged portions, and a spring portion for moving the manipulation portion back to its initial position.

In some embodiments, (a) the inserted portion may extend downward as extending away from the base; or (b) an upper surface of the inserted portion may be substantially parallel to an insertion direction of the inserted portion into the housing, and a lower surface of the inserted portion may be tilted downward as extending away from the base; or (c) a lower surface of the inserted portion may be substantially parallel to an insertion direction of the inserted portion into the housing, and an upper surface of the inserted portion may be tilted downward as extending away from the base.

According to an aspect of the present disclosure, a coupling strength of a buckle may be enhanced without at least greatly deteriorating a thinness of a buckle.

DETAILED DESCRIPTION

Hereinafter, non-limiting embodiments of the present invention will be described with reference to FIGS. 1 to 22. One or more disclosed exemplary embodiments and respective features included therein are not mutually exclusive. A skilled person could properly combine the respective exemplary embodiments and/or respective features without requiring excess descriptions. A skilled person should understand the synergic effects by such combinations. Overlapping descriptions among embodiments will be basically omitted. Referenced figures are mainly for the purpose of illustrating the invention and may be simplified for the sake of convenience of preparation of figures.

Figure 1:
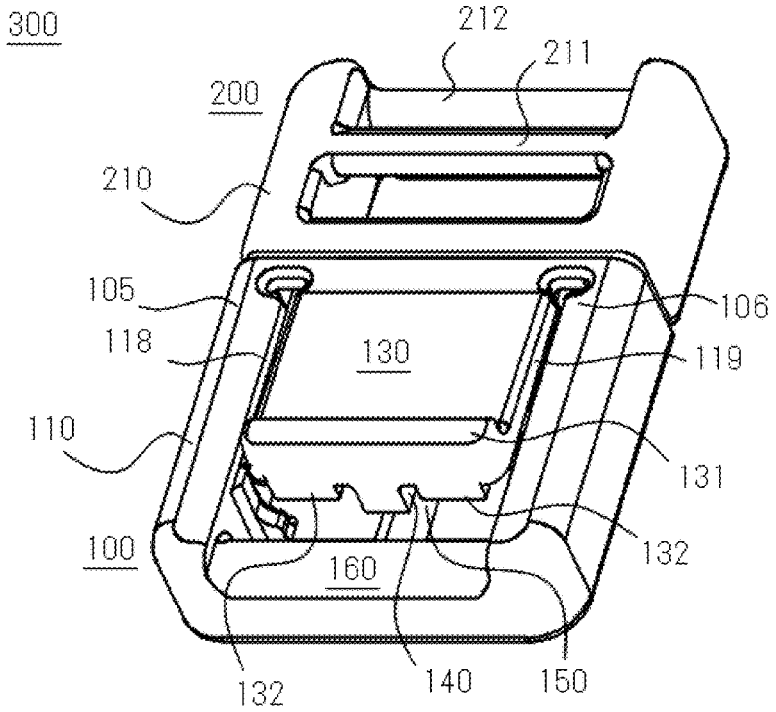
FIG. 1 is a schematic perspective view of a buckle according to an aspect of the present disclosure.
Figure 2:
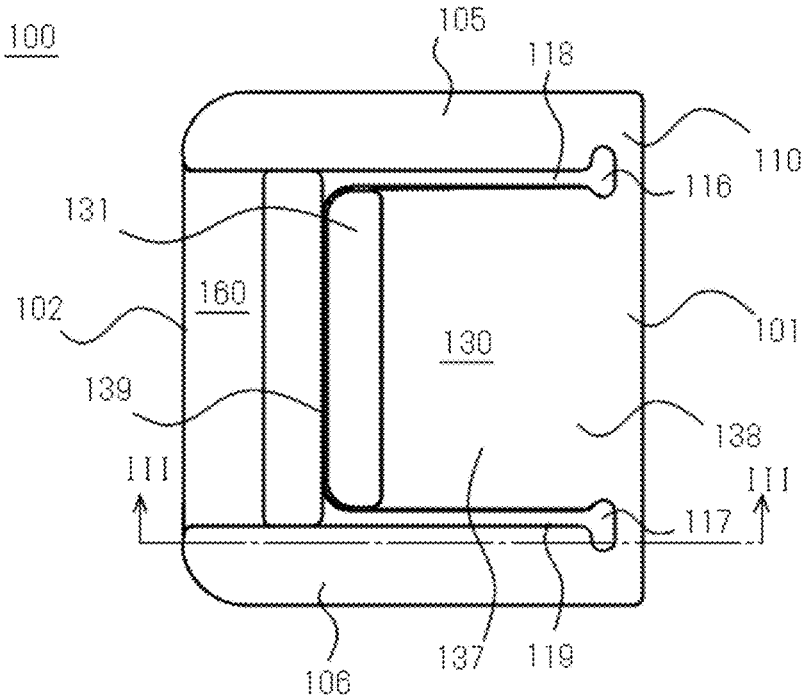
FIG. 2 is a schematic top view of a female part of a buckle according to an aspect of the present disclosure.
Figure 3:
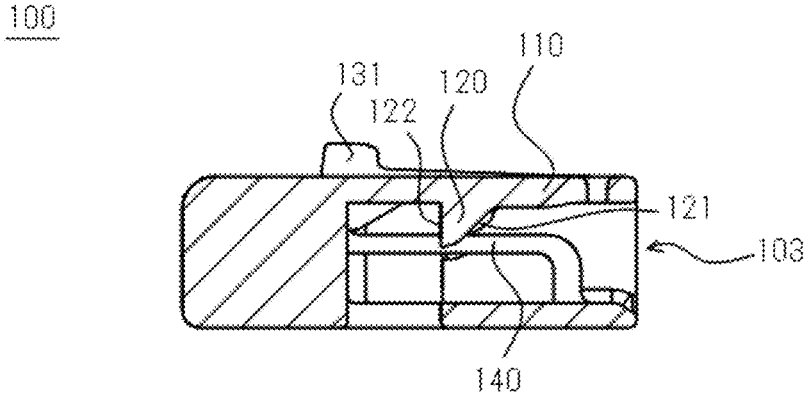
FIG. 3 is schematic sectional view of a female part taken along in FIG. 2.
Figure 4:
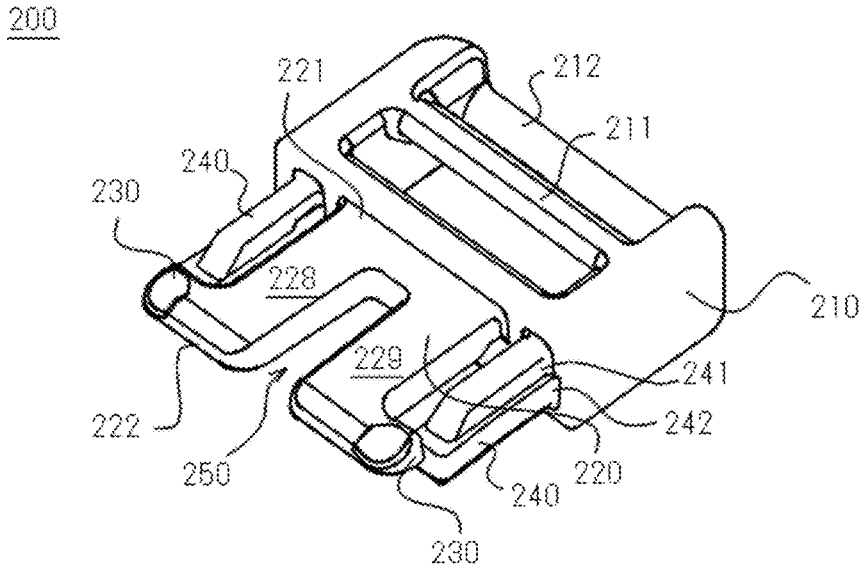
FIG. 4 is a schematic perspective view of a male part of a buckle according to an aspect of the present disclosure.
Figure 5:
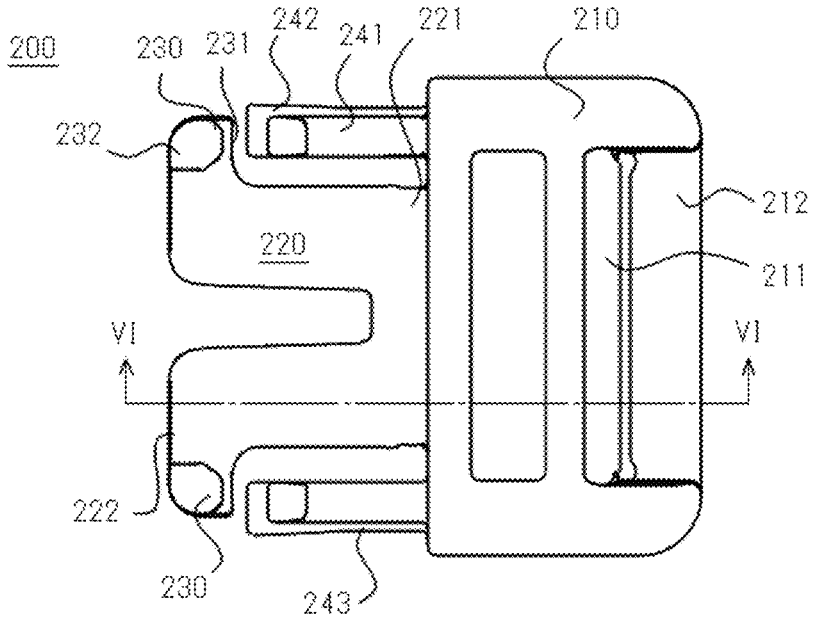
FIG. 5 is a schematic top view of a male part of a buckle according to an aspect of the present disclosure.
Figure 6:
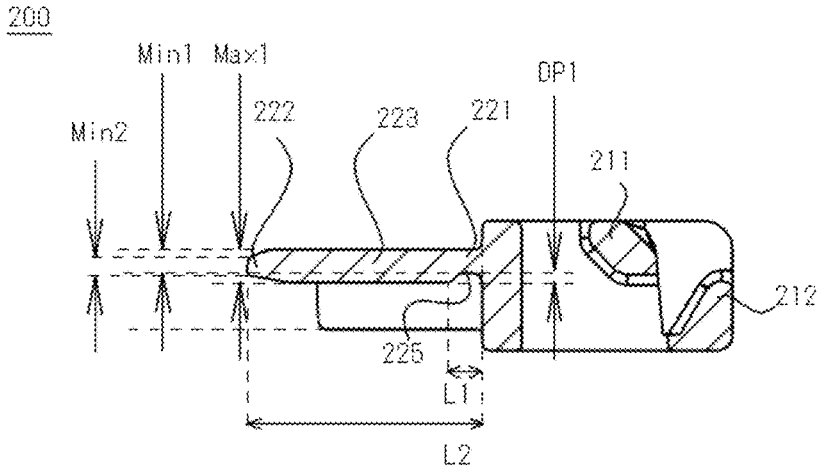
FIG. 6 is a schematic sectional view of a male part taken along VI-VI in FIG. 5.
Figure 7:
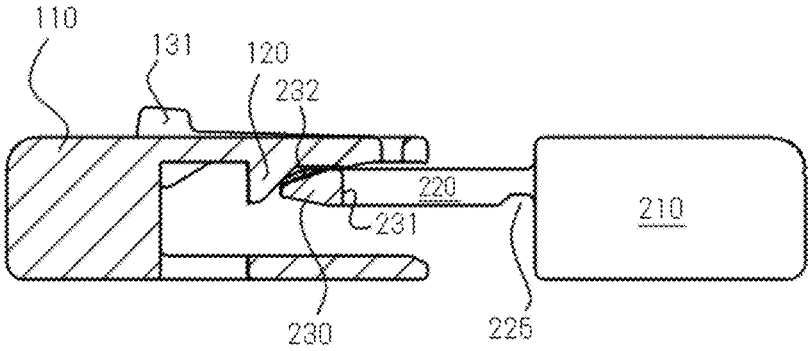
FIG. 7 is a schematic sectional view for illustrating the process of coupling of male and female parts.
Figure 8:
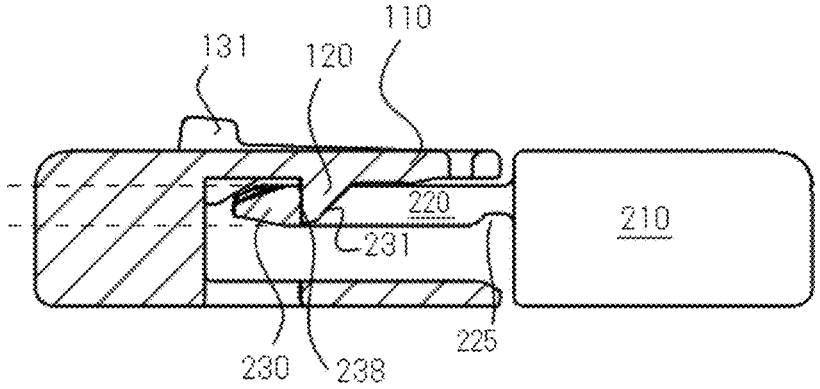
FIG. 8 is a schematic sectional view for illustrating the process of coupling of male and female parts.
Figure 9:
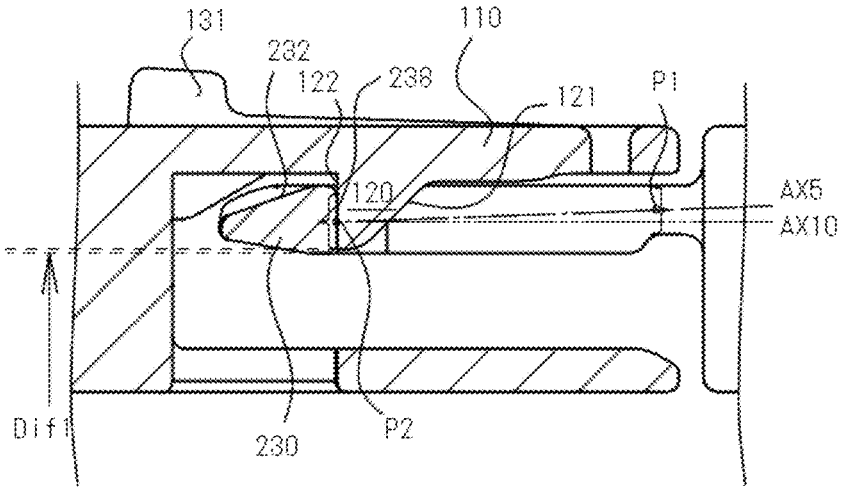
FIG. 9 is a partially expanded schematic view illustrating the engaged state between an engaging portion of a female part and an engaged portion of a male part.
Figure 10:
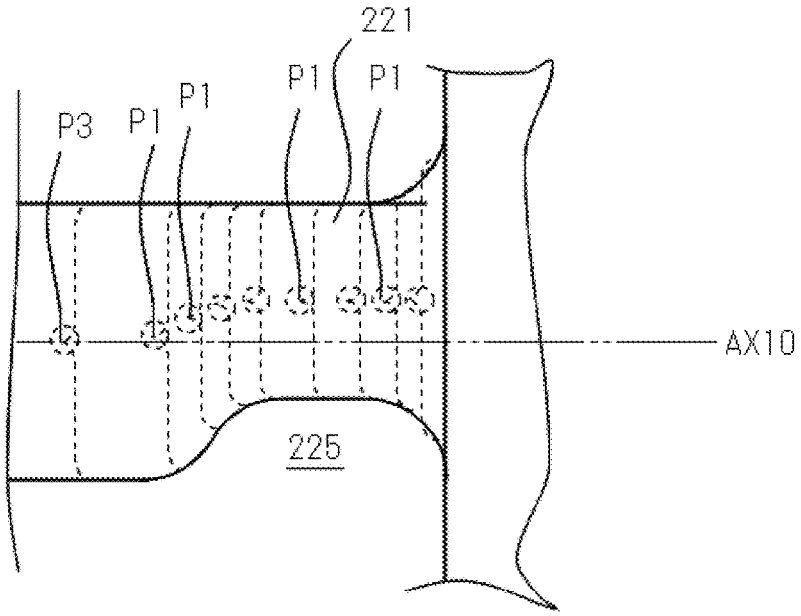
FIG. 10 is a partially expanded schematic view to show a base end of an inserted portion of a male part, schematically illustrating an interrelation of positions between a center point P1 at the base end in the thickness direction of the inserted portion and a center point P3 at a middle portion of the inserted portion in the thickness direction of the inserted portion. Dotted circle and dotted parenthesis are illustrated to point out the positions of the center points.
Figure 11:
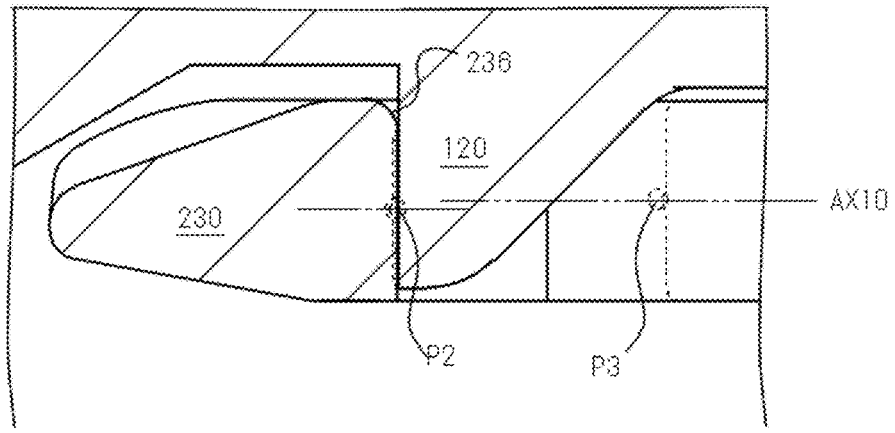
FIG. 11 is a partially expanded schematic view to show a state in which an engaging portion of a female part and an engaged portion of a male part are in contact in a plane, schematically illustrating an interrelation of positions between a center point P2 at a contact surface in the thickness direction of an inserted portion and a center point P3 at a middle portion of the inserted portion in the thickness direction of the inserted portion. Dotted circle and dotted parenthesis are illustrated to point out the positions of the center points.
Figure 12:
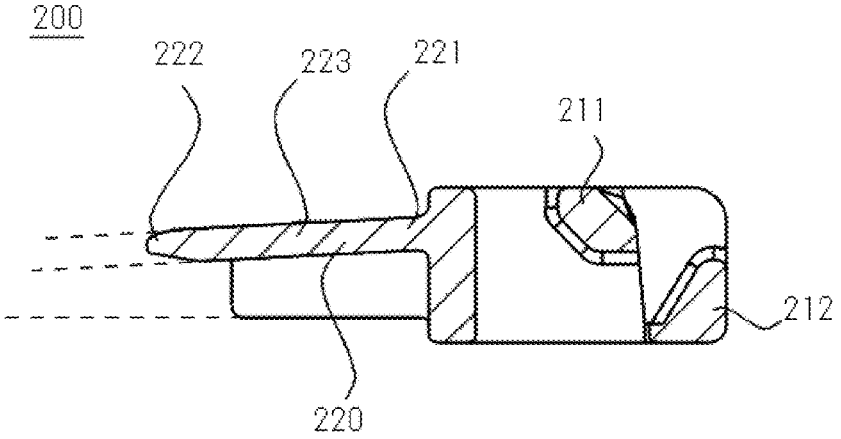
FIG. 12 is a schematic sectional view of a male part according to a second exemplary embodiment.
Figure 13:
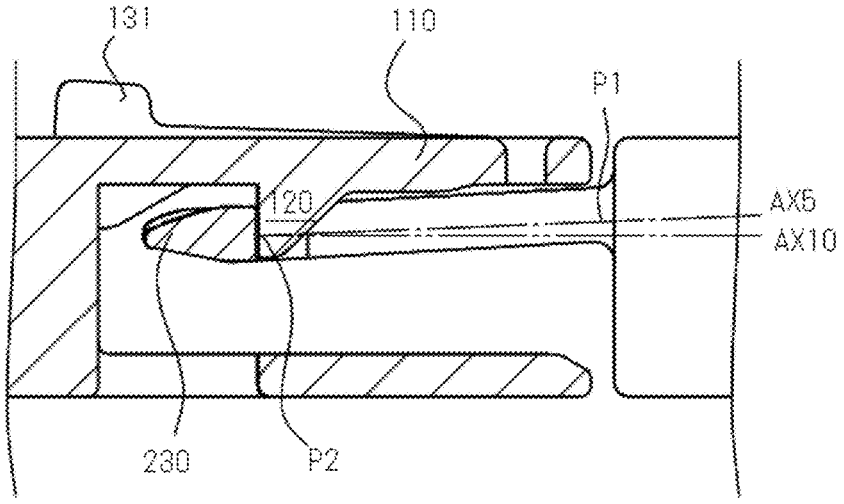
FIG. 13 is a partially expanded schematic view to shown a state in which an engaging portion of a female part and an engaged portion of a male part are engaged in accordance with a second exemplary embodiment.
Figure 14:
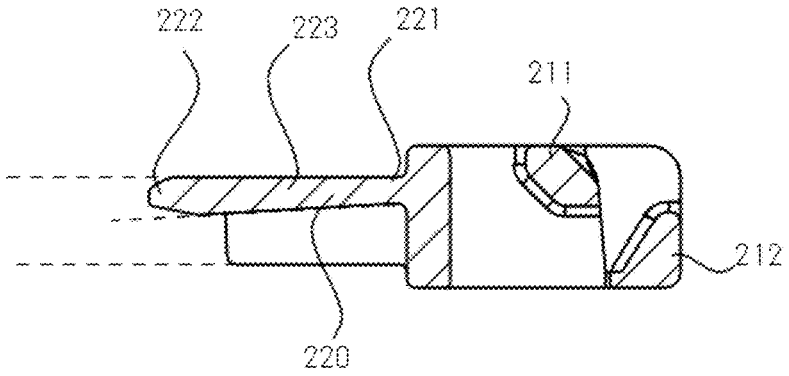
FIG. 14 is a schematic sectional view of a male part according to a third exemplary embodiment.
Figure 15:
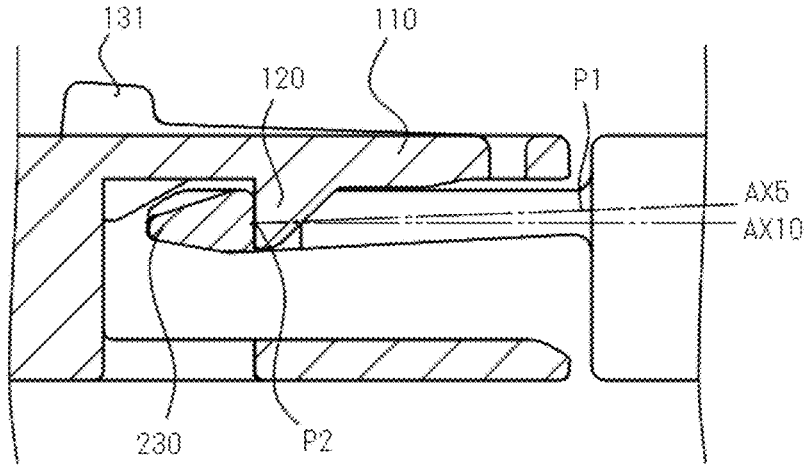
FIG. 15 is a partially expanded schematic view to shown a state in which an engaging portion of a female part and an engaged portion of a male part are engaged in accordance with a third exemplary embodiment.
Figure 16:
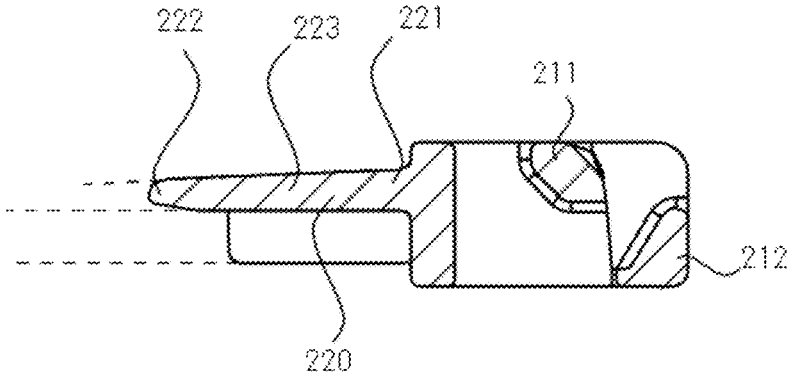
FIG. 16 is a schematic sectional view of a male part according to a forth exemplary embodiment.
Figure 17:
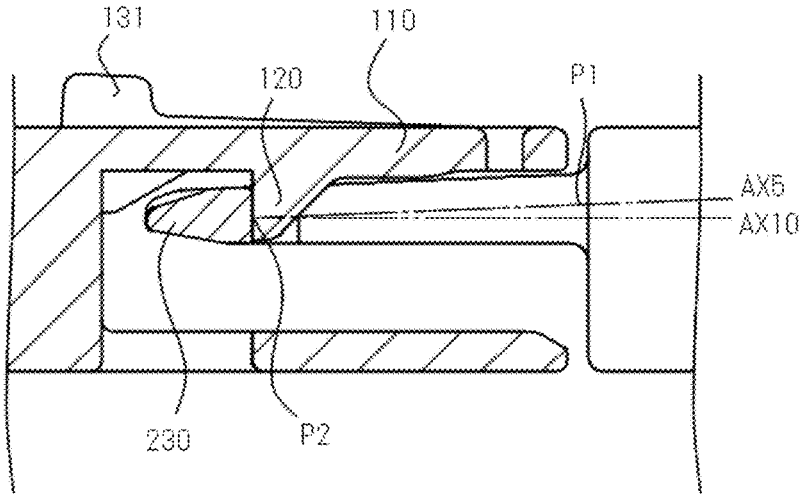
FIG. 17 is a partially expanded schematic view to shown a state in which an engaging portion of a female part and an engaged portion of a male part are engaged in accordance with a forth exemplary embodiment.
Figure 18:
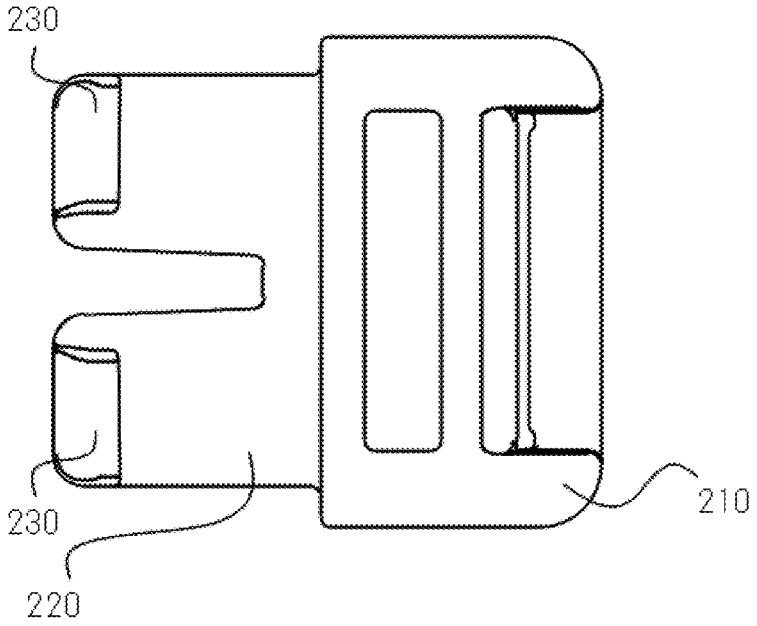
FIG. 18 is a schematic top view of a male part according to a fifth exemplary embodiment.
Figure 19:
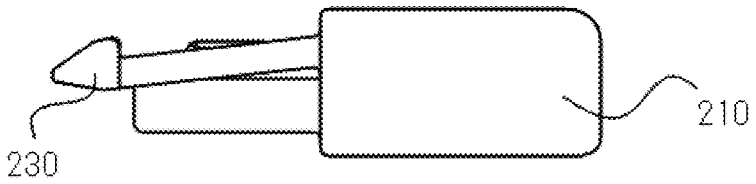
FIG. 19 is a schematic side view of a male part according to a fifth exemplary embodiment.
Figure 20:
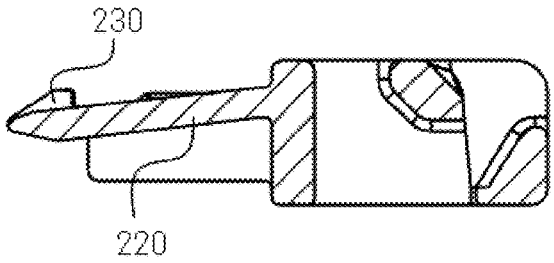
FIG. 20 is a schematic sectional view of a male part according to a fifth exemplary embodiment.
Figure 21:
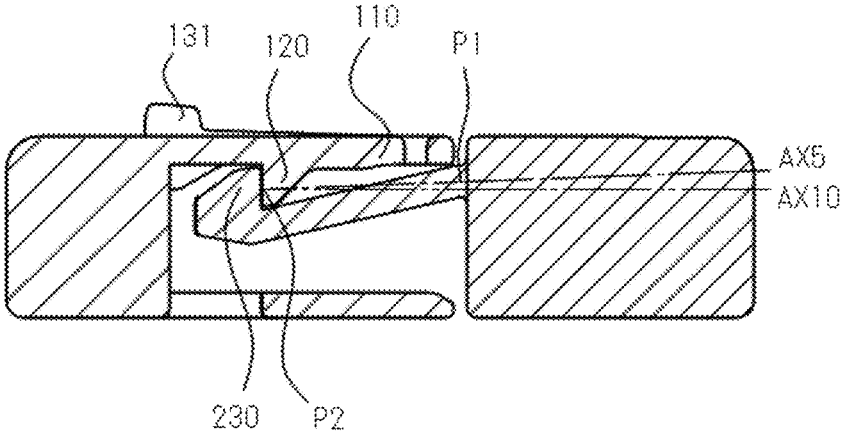
FIG. 21 is a partially expanded schematic view to shown a state in which an engaging portion of a female part and an engaged portion of a male part are engaged in accordance with a fifth exemplary embodiment.
Figure 22:
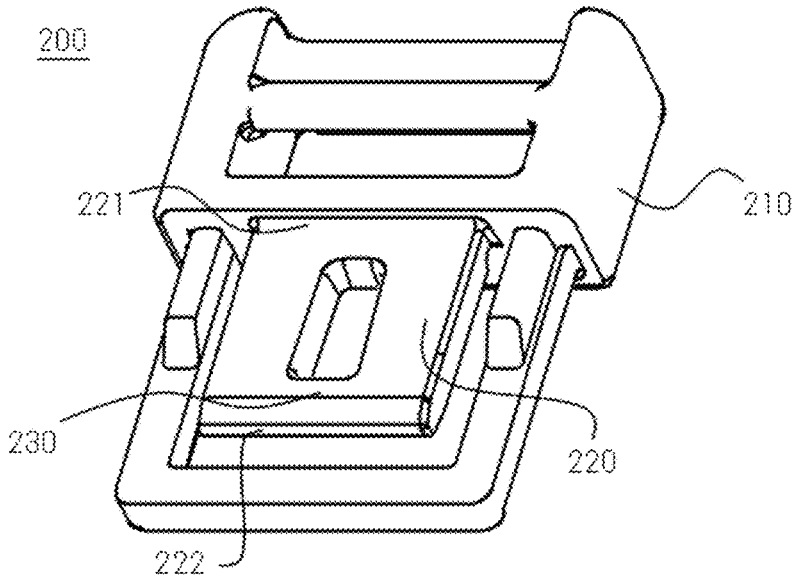
FIG. 22 is a schematic perspective view of a male part according to a sixth exemplary embodiment.

FIG. 1 is a schematic perspective view of a buckle according to an aspect of the present disclosure. FIG. 2 is a schematic top view of a female part of a buckle according to an aspect of the present disclosure. FIG. 3 is schematic sectional view of a female part taken along in FIG. 2. FIG. 4 is a schematic perspective view of a male part of a buckle according to an aspect of the present disclosure. FIG. 5 is a schematic top view of a male part of a buckle according to an aspect of the present disclosure. FIG. 6 is a schematic sectional view of a male part taken along VI-VI in FIG. 5. FIG. 7 is a schematic sectional view for illustrating the process of coupling of male and female parts. FIG. 8 is a schematic sectional view for illustrating the process of coupling of male and female parts. FIG. 9 is a partially expanded schematic view illustrating the engaged state between an engaging portion of a female part and an engaged portion of a male part. FIG. 10 is a partially expanded schematic view to show a base end of an inserted portion of a male part, schematically illustrating an interrelation of positions between a center point P1 at the base end in the thickness direction of the inserted portion and a center point P3 at a middle portion of the inserted portion in the thickness direction of the inserted portion. Dotted circle and dotted parenthesis are illustrated to point out the positions of the center points. FIG. 11 is a partially expanded schematic view to show a state in which an engaging portion of a female part and an engaged portion of a male part are in planar contact, schematically illustrating an interrelation of positions between a center point P2 at a contact surface in the thickness direction of an inserted portion and a center point P3 at a middle portion of the inserted portion in the thickness direction of the inserted portion. Dotted circle and dotted parenthesis are illustrated to point out the positions of the center points. FIG. 12 is a schematic sectional view of a male part according to a second exemplary embodiment. FIG. 13 is a partially expanded schematic view to shown a state in which an engaging portion of a female part and an engaged portion of a male part are engaged in accordance with a second exemplary embodiment. FIG. 14 is a schematic sectional view of a male part according to a third exemplary embodiment. FIG. 15 is a partially expanded schematic view to shown a state in which an engaging portion of a female part and an engaged portion of a male part are engaged in accordance with a third exemplary embodiment. FIG. 16 is a schematic sectional view of a male part according to a forth exemplary embodiment. FIG. 17 is a partially expanded schematic view to shown a state in which an engaging portion of a female part and an engaged portion of a male part are engaged in accordance with a forth exemplary embodiment. FIG. 18 is a schematic top view of a male part according to a fifth exemplary embodiment. FIG. 19 is a schematic side view of a male part according to a fifth exemplary embodiment. FIG. 20 is a schematic sectional view of a male part according to a fifth exemplary embodiment. FIG. 21 is a partially expanded schematic view to shown a state in which an engaging portion of a female part and an engaged portion of a male part are engaged in accordance with a fifth exemplary embodiment. FIG. 22 is a schematic perspective view of a male part according to a sixth exemplary embodiment.

FIG. 1 shows a buckle 300 in which a female part 100 and a male part 200 are coupled. The buckle 300 may be a type of fastening implements such as slide fasteners, buttons and so on and may be employed for various types of products such as clothes, bags, and backpacks and so on. In some cases, the female part 100 and male part 200 may be produced through injection molding of resin. A various type of resin may be employed. In some cases, synthetic resin such as a polyamide or polyacetal. In another case, non-resin member such as a metal may be embedded in a molded resin product.

As shown in FIG. 2 and FIG. 3, the female part 100 may have a housing 110, and an engaging portion 120 provided at an inner surface of the housing 110. The housing 110 may be tubular in some embodiments. As shown in FIGS. 4 to 6, the male part 200 may have a base 210, and an inserted portion 220 to be inserted into the housing 110 of the female part 100. The inserted portion 220 may have a base end 221 coupled to the base 210, a free end 222 opposite to the base end 221, and an engaged portion 230 to be engaged with the engaging portion 120. As understandable from FIG. 1, the housing 110 of the female part 100 and the base 210 of the male part 200 have the same or equivalent width and thickness. Therefore, when the female part 100 and the male part 200 are coupled, the buckle 300 is seen as if it is a one part.

The housing 110 of the female part 100 may have an open end 101 at which an opening 103 is provided which serves as an in-and-out mouth for insertion of the inserted portion 220 of the male part 200 and for pull-out thereof, and may have an opposite end 102 opposite to the open end 101 in the insertion direction of the inserted portion 220 into the housing 110. At the open end 101 of the housing 110, upper wall, left wall, bottom wall and right wall are continuously provided to define the above-described opening 103.

It may be noted that the insertion direction of the inserted portion 220 into the housing 110 may be a direction which could be naturally understandable by referring to FIGS. 7 and 8. More concretely, the insertion direction referred in this specification may be a direction along an axis AX10 of two-dot chain line shown in FIG. 9. Hereinbelow, the insertion direction of the inserted portion 220 into the housing 110 may be referred simply as an insertion direction. An up and down direction may be perpendicular to the insertion direction. The up and down direction may be equal to a thickness direction of a buckle 300, a thickness direction of the female part 100, and a thickness direction of the male part 200. A left and right direction may be equal to a width direction of the buckle 300, a width direction of the female part 100, and a width direction of the male part 200. It may be noted that the buckle 300 may be a small flat product having a thickness less than a width. The same holds true to the female part 100 and the male part 200. The up and down direction, as understandable from descriptions below, may be a direction along the thickness direction of the inserted portion 220 and the pivot direction of the inserted portion 220. The left and right direction may be perpendicular to the insertion direction and the up and down direction.

The housing 110 of the female part 100 may have a manipulation portion 130 between the open end 101 and the opposite end 102 which is for releasing the engagement between the engaging portion 120 and the engaged portion 230. The manipulation portion 130 of the illustrated example may be provided at the upper wall of the housing 110 and, in other words, configure a portion of the upper wall. The manipulation portion 130 may extend along the insertion direction of the inserted portion 220 into the housing 110. A pair of slits 118, 119 may exist adjacent to the manipulation portion 130 at its both sides, i.e. at both left and right sides thereof. The respective slits 118, 119 extend along the insertion direction of the inserted portion 220 into the housing 110. The respective slits 118, 119 are in spatial communication with holes 116, 117, each having a wider width than the slit width and being positioned proximate to the open end 101 of the housing 110.

The manipulation portion 130 may have a base end 138 coupled to the open end 101 and a free end 139 opposite to the base end 138 in the insertion direction, and may be elastically pivotable around the base end 138 as a pivot center. The manipulation portion 130, configuring a portion of the upper wall of the housing 110, may be coupled to the bottom wall of the housing 110 via a spring portion 140. This may allow the manipulation portion 130 having been downwardly moved to be at a displaced position to move back to its initial position. In other words, the spring portion 140 may be provided to ensure such elastic feature of manipulation portion 130. In some cases, the spring portion 140 may extend between the bottom wall of the housing 110 and the manipulation portion 130 while being bent at one or more places therebetween. The spring portion 140 of the illustrated example may be a resin spring integrally provided with the housing 110. In another example, a metal spring may be incorporated inside the housing 110.

The spring portion 140 may be provided inside the housing 110 and downward relative to the manipulation portion 130. The spring portion 140 may have a bottom post upwardly extending from the bottom wall of the housing 110 beneath the base end 138 of the manipulation portion 130; a top post downwardly extending from the free end 139 of the manipulation portion 130, and an intermediate extending portion extending between the top end of the bottom post and the lower end of the top post to coupled them. The intermediate extending portion of the spring portion 140 may extend along the insertion direction of the inserted portion 220 into the housing 110. When the manipulation portion 130 is pushed and downwardly displaced, a bent portion between the top post and the intermediate extending portion of the spring portion 140 may be downwardly displaced to reach the level of the bottom wall of the housing 110. In the illustrated example, the bottom wall of the housing 110 may have a receiving portion 150 which can receive the downwardly displaced bent portion, thereby avoiding the interference with the spring portion 140. The receiving portion 150 may extend along the insertion direction. The illustrated receiving portion 150 may penetrate through the bottom wall of the housing 110, but may be recessed without penetrating through the bottom wall in another example.

The manipulation portion 130 may have a middle portion 137 between the base end 138 and the free end 139. The width of the middle portion 137 may be defined by the slits 118, 119. The width W138 of the base end 138 may be defined by the holes 116, 117. W137>W138 may be satisfied so that pivoting of the manipulation portion 130 may be facilitated.

An upper surface of the free end 139 of the manipulation portion 130 may be provided with a top projection 131 upwardly projected. The top projection 130 may serve to prevent a slip of thumb of human which may be placed on the manipulation portion 130 for pressing the manipulation portion 130 downward. A lower surface of the free end 139 of the manipulation portion 130 may be provided with a bottom projection 132 for pushing the free end 222 of the inserted portion 220 downward. As the bottom projection 132, left and right bottom projections may be provided corresponding to left and right inserted portions 228, 229 of the inserted portion 220 described below. It may be not necessary for the manipulation portion 130 to extend along the insertion direction. Another example will be envisaged in which the manipulation portion 130 may extend along a different direction. Another example will be envisaged in which plural manipulation portions 130 are provided.

A bar 160 extending in left and right direction may be provided at the opposite end 102 of the housing 110 of the female part 100. The bar 160 may be positioned farther than the free end 139 of the manipulation portion 130 relative to the open end 101 of the housing 110 in the insertion direction. The housing 110 may have a left top wall 105 extending from the open end 101 to the left end of the bar 160, and a right top wall 106 extending from the open end 101 to the right end of the bar 160. The lower surface of the left top wall 105 may be provided with a left engaging portion 120, and the lower surface of the right top wall 106 may be provided with the right engaging portion 120. The lower surfaces of the left and right top wall 105, 106 are equal to the inner surface of the housing 110.

As understandable from FIG. 3, the engaging portion 120 may project downward from the top wall of the housing 110. In some cases, the engaging portion 120 may be coupled to the left or right wall additionally to the top wall. The engaging portion 120 may have a sloped surface 121 provided to face the opening 103 and an engaging surface 122 at the opposite side of the sloped surface 121 in the insertion direction. The engaging surface 122 may be perpendicular to the lower surface of the top wall of the housing 110. It may be noted that two engaging portions 120 are provided in the illustrated example, but one engaging portion 120 or two or more engaging portions 120 may be provided in another example.

A top opening may be provided between the manipulation portion 130 and the bar 160. Beneath the top opening, there may be a bottom opening between the bottom wall of the housing 110 and the bar 160. A belt or cord may be wounded around the bar 160 through the top and bottom openings which are continuously arranged in the up and down direction. The above-described pair of slits 118, 119 may be in spatial communication with the top opening. The above-described receiving portion 150 penetrating through the bottom wall of the housing 110 may be in spatial communication with the bottom opening.

As discussed above, the male part 200 may have the base 210, and the inserted portion 220 to be inserted into the housing 110 of the female part 100. Optionally, the male part 200 may be further provided with a pair of guides 240 which are arranged at both left and right sides of the inserted portion 220. Each guide 240 may have a base end coupled to the base 210 and a free end positioned away from the base 210 in the insertion direction, and linearly extends along the insertion direction between these base end and free ends. Each guide 240 may be inserted into the housing 110 of the female part 100 together with the inserted portion 220. Each guide 240 may be thicker than the inserted portion 220 and may have an equivalent thickness with the up and down width of opening 103 of the housing 110 of the female part 100. By providing the guide 240, insertion of the inserted portion 220 into the housing 110 of the female part 100 may be easily performed. It may be noted that the inserted portion 220 may be configured to be relatively thin for securing its elastic deformation, and thus the guide 240 may be provided to compensate for the difficulty of the insertion due to the thinness of the inserted portion 220.

The base 210 of the male part 200 may be a portion being not inserted into the housing 110 of the female part 100 and may be provided with one or more bars 211, 212 for allowing a belt or cord to be wound around. Each bar 211, 212 may extend in the left and right direction, similar to the bar 160 of the housing 110 of the female part 100.

The inserted portion 220 may have the base end 221 coupled to the base 210, the free end 222 opposite to the base end 221, and the engaged portion 230 to be engaged with the engaging portion 120. The inserted portion 220, while having a thickness, may extend from the base end 221 toward the free end 222. The inserted portion 220 may elastically pivotable around the base end 221 as a pivot center to allow engagement and disengagement of the engaging and engaged portions 120, 230. When the inserted portion 220 is inserted into the housing 110 of the female part 100 and when the inserted portion 220 is pulled out of the housing 110 of the female part 100, the inserted portion 220 may elastically pivot.

The inserted portion 220 may be positioned closer to the upper surface of the base 210 of the male part 200 to ensure the engagement between the engaging portion 120 provided at the lower surface of the top wall of the housing 110 of the female part 100 and the engaged portion 230 provided at the inserted portion 220. The inserted portion 220 may have an opening 250 extending in the insertion direction toward the base end 221 of the inserted portion 220 from the free end 222 of the inserted portion 220 in order to avoid interference with the spring portion 140, particularly with the bottom post and intermediate coupling portion, inside the housing 110 of the female part 100 described above. Due to the opening 250, the inserted portion 220 may have a bifurcated shape, namely a left inserted portion 228 and a right inserted portion 229. The inserted portion 220 may be sectioned into the left inserted portion 228 and the right inserted portion 229 by the opening 250, thereby facilitating the easiness of elastic deformation of the inserted portion 220.

The inserted portion 220 may have a groove 225 that may be provided at the lower surface of the base end 221 and may extend in the left and right direction, in other words, in the width direction of the inserted portion 220. This groove 225 may be provided not mainly for facilitating the pivot deformation of the inserted portion 220. The inserted portion 220 may be able to sufficiently deform elastically without requiring the provision of the groove 225. As understandable from the following descriptions, this groove 225 may be provided for the purpose of enhancing the coupling strength of the buckle 300, not necessarily limited though. The groove 225 should not be limited to a groove having a rectangular sectional shape as in the illustrated example, but may be a groove having a triangular sectional shape. The bottom surface of the groove 225 may be positioned at the uppermost position at the lower surface of the base end 221 of the inserted portion 220. There will be no need for the groove 225 to continuously extend in the left and right direction or in the width direction. In some cases, a plurality of grooves 225 may be provided in the left and right direction, and the respective grooves 225 may be arranged on the same line, or they may be arranged parallel to cross the insertion direction. The depth of the groove 225 may be variously set in each embodiment.

In some cases, the maximum thickness Max 1 of the inserted portion 220 may be equal to or less than 1.7 mm. The minimum thickness Min 2 of the inserted portion 220 may be equal to or less than 0.8 mm. The maximum depth Dp1 of the groove may be equal to or less than 0.9 mm or 0.5 mm. The minimum thickness Min 1 of the base end 221 of the inserted portion 220 may be equal to or less than 1.2 mm or 0.8 mm. The width L1 of the groove 225 in the insertion direction may be 1.5 mm. The length L2 of the inserted portion 220 in the insertion direction may be 12.1 mm. The dimension of a hollow of the housing 110 in the height direction may be 4.2 mm. When the maximum thickness Max 1 of the inserted portion 220 is 1.7 mm and when the male part and the female part are coupled, the remaining dimension of the hollow of the housing 110 may be 2.5 mm. This remaining dimension of the hollow may serve as a space that allows the elastic deformation of the inserted portion 220 and may be equal to or greater than the maximum thickness Max 1 of the inserted portion 220.

In some cases, the depth of the groove 225 may be equal to or less than a value calculated by multiplying (the maximum thickness of the middle portion 223 of the inserted portion 220 between the base end 221 and the free end 222 of the inserted portion 220) and (5/6). In some cases, the depth of the groove 225 may be equal to or less than a half of the maximum thickness of the middle portion 223 of the inserted portion 220 between the base end 221 and the free end 222 of the inserted portion 220. Deeper the depth of the groove 225 may be, higher the coupling strength may be. However, if the groove 225 was too deep, a probability of break of the inserted portion 220 at a point of the groove 225 may increase. In some cases, in view of such issue, the minimum thickness of the inserted portion 220 at the position of groove 225 may be equal to or greater than a value calculated by multiplying (the maximum thickness of the middle portion 223 of the inserted portion 220) and (1/6), In some cases, the minimum thickness of the inserted portion 220 at the position of the groove 225 may be equal to or greater than a value calculated by multiplying (the maximum thickness of the middle portion 223 of the inserted portion 220) and (1/6), and equal to or less than a value being calculated by multiplying (the maximum thickness of the middle portion 223 of the inserted portion 220) and (2/3). In some cases, the minimum thickness of the inserted portion 220 at the position of the groove 225 may be equal to or greater than a value calculated by multiplying (the maximum thickness of the middle portion 223) and (1/3), and may be equal to or less than a value calculated by multiplying (the maximum thickness of the middle portion 223) and (2/3).

In some cases, the width L1 of the groove 225 in the insertion direction of the inserted portion 220 into the housing 110 may be equal to or less than a value calculated by multiplying (the length L2 of the inserted portion 220 in the insertion direction) and (1/6).

The inserted portion 220 may have the engaged portion 230 to be engaged by the engaging portion 120. The engaged portion 230 may be arranged closer to the free end 222 of the inserted portion 220 and may be projected in the left and right direction (may be projected away from the opening 250 in the width direction of the inserted portion 220, in other words). The inserted portion 220 may be thinned compared to a case where the engaged portion 230 is projected in the up and down direction, thereby facilitating the thinning of buckle 300. In some cases including the illustrated example, the engaged portion 230 may have a thickness equal to or less than the maximum thickness of the inserted portion 220. Note that the width direction of the inserted portion 220 may be perpendicular to the insertion direction of the inserted portion 220 into the housing 110 and the thickness direction of the inserted portion 220.

The free end 222 of the inserted portion 220 may be tapered. The engaged portion 230 may have an engaged surface 231 provided to face the base 210, and a sloped surface 232 opposite to the engaged surface 231 in the insertion direction. The sloped surface 232 may be a downward sloped surface downwardly extends as extending away from the base 210. The gradient of the sloped surface 232 may be less than the gradient of the sloped surface 121 of the engaging portion 120.

The guide 240 may have a top guide 241 and a bottom guide 242. The top guide 241 may be narrower than the bottom guide 242 in the left and right width, and may be positioned closer to the inserted portion 220 than the bottom guide 242 in the left and right direction. A step 243 may be provided between the top guide 241 and the bottom guide 242. A projection that fits with this step 243 may be provided at the housing 110 of the female part 100. Easiness of insertion of the inserted portion 220 and the guide 240 of the male part 200 into the housing 110 of the female part 100 may be improved.

A clearance may exist between the free end of the guide 240 and the engaged portion 230 of the inserted portion 220, suppressing interference between the guide 240 and the engaged portion 230 at the time of pivotal displacement of the inserted portion 220.

How the female part 100 and the male part 200 are coupled will be described with reference to FIGS. 7 and 8. Firstly, the inserted portion 220 of the male part 200 is inserted into the hollow of the housing 110 through the opening 103 at the open end 101 of the housing 110 of the female part 100. The free end 222 of the inserted portion 220 passes through the opening 103 and enters into the hollow of the housing 110, and then the free end of the guide 240 passes through the opening 103 and enters into the hollow of the housing 110. After that the free end of the guide 240 has entered into the hollow of the housing 110, the engaged portion 230 of the inserted portion 220 bumps against the engaging portion 120 projecting downward from the top wall of the housing 110. The engaged portion 230 may be guided by the sloped surface 121 of the engaging portion 120 and may be displaced downward as moving forward. The downward displacement of the engaged portion 230 may be equal to the transition of the inserted portion 220 from the initial posture to the deformed posture. More specifically, each of the left inserted portion 228 and the right inserted portion 229 may be displaced downward, i.e. flexed downward. In response to that the engaged portion 230 has passed through the tip (bottom tip) of the engaging portion 120, the inserted portion 220 elastically recovers to the initial posture from the deformed posture. As shown in FIG. 8, the engaged portion 230 overpasses the engaging portion 120. The engaged portion 230 and the engaging portion 120 touches one another in a plane. That is, the engaged surface 231 of the engaged portion 230 and the engaging surface 122 of the engaging portion 120 are in planar contact at the contact surface 238.

In some cases, when the female part 100 and the male part 200 are coupled, a play space, i.e. clearance may be provided between the engaged portion 230 and the engaging portion 120. Therefore, it could be more precise to describe that the engaged portion 230 may have the contact surface 238 that is in planar contact with the engaging portion 120, when a force is applied to the male part 200 for pulling the male part 200 out of the housing 110. The contact surface 238 may be included in the engaged surface 231 of the engaged portion 230. At the contact surface 238, the engaging surface 122 of the engaging portion 120 and the engaged surface 231 of the engaged portion 230 may be in planar contact one another.

It has been described that the male part 200 is moved relative to the stationary female part 100. However, the same phenomenon may be caused even when the male part 200 is kept stationary and the female part 100 is moved thereto, and this would be similarly understandable for a skilled person.

With reference to FIGS. 9 to 11, descriptions will be made for the increase in coupling strength of the buckle 300. In some embodiments, relative to a first center point P1 at the center of the base end 221 in the thickness direction of the inserted portion 220, a second center point P2 at the center of the contact surface 238 in the thickness direction of the inserted portion 220 is positioned downward. In this case, when a force is applied for releasing the engagement of the female part 100 and the male part 200 without any manipulation against the manipulation portion 130, a force may be caused to urge the inserted portion 220 upward not downward, preventing the engaged portion 230 from moving in a way to overpass the engaging portion 120. As a result, the coupling strength of the buckle 300 may be enhanced. It may be noted that an (imaginary) axis AX5 extending between the first center point P1 and the second center point P2 may be tilted relative to the insertion direction of the inserted portion 220 into the housing 110. In FIG. 9, an (imaginary) axis AX10 which is identical to the insertion direction is illustrated just for a reference. In some cases, an angle between the axis AX10 and the axis AX 5 may be 2.0 to 10.0 degree or 2.2 to 5.0 degree.

In an example illustrated in FIGS. 1 to 11, the first center point P1 is shifted upward by providing the groove 225 at the base end 221 of the inserted portion 220, resulting in that the second center point P2 is positioned downward relative to the first center point P1. The thickness of the inserted portion 220 may be not affected by the presence of the groove 225, thus enhancing the coupling strength of the buckle 300 without deteriorating a thinness of the buckle 300.

Just for a caution, downward may be a direction along movement of the inserted portion 220 from the initial posture toward the deformed posture at the time of engagement or disengagement of the engaging and engaged portions 120, 230. Upward may be a direction of movement of the inserted portion 220 recovering from the deformed posture to the initial posture.

As shown in FIG. 10, the first center point P1 may shift upward due to the groove 225 at the base end 221 of the inserted portion 220. The upward shifting of the first center point P1 may be recognizable in comparison to the third center point P3 in the middle portion 223 of the inserted portion 220 in the thickness direction of the inserted portion 220. The upward shifting of the first center point P1 may be caused in accordance with the upward shifting of the lower surface of the inserted portion 220. The upward shifting of the lower surface of the inserted portion 220 may be caused in accordance with the groove 225. In FIG. 10, a plurality of first center points P1 are exemplary illustrated. In some cases, the first center point P1 at a position of the maximum depth of the groove 225 may be utilized for the comparison with the second center point P2 or for the determination of the (imaginary) axis AX5.

As illustrated in FIG. 11, the second center point P2 at the contact surface 238 in the thickness direction of the inserted portion 220 may be positioned downward relative to the third center point P3 at the middle portion 223 of the inserted portion 220 in the thickness direction of the inserted portion 220. The engaged portion 230 may have a non-contact surface 236, not in contact with the engaging portion 120 when the engaging and engaged portions 120, 230 are engaged, between the upper surface and the contact surface 238 of the engaged portion 230. The contact surface 238 is shifted downward due to the non-contact surface 236, thus contributing to increase the tilt of the (imaginary) axis AX5. The non-contact surface 236 may have a round rim between the upper surface and the contact surface 238 of the engaged portion 230.

In some cases, as shown in FIG. 11, the tip of the engaging portion 120 does not project downward from the lower surface of the engaged portion 230.

The above description focuses to describe the relationship of the first center point P1 and the second center point P2. However, additionally or alternatively, the same effect may be obtained simply by providing the groove 225 at the base end 221 of the inserted portion 220. In some cases, following conditions may be satisfied: (a) the minimum thickness of the base end 221 of the inserted portion 220 may be less than the thickness of the middle portion 223, and (b) the length of the contact surface 238 in the up and down direction may be less than the thickness of the middle portion 223.

Alternatively or additionally, it may be understood that similar effect can be obtained when a position at a lower end of the contact surface 238 of the engaged portion 230 may be positioned downward relative to the uppermost position at the lower surface of the base end 221 of the inserted portion 220. In some cases, following conditions may be satisfied: (a) the thickness or the minimum thickness of the base end 221 of the inserted portion 220 may be equal to or less than the maximum thickness of the inserted portion 220, and (b) the length of the contact surface 238 in the up and down direction may be equal to or less than the maximum thickness of the inserted portion 220. In some cases, the lower end position of the contact surface 238 of the engaged portion 230 may be equal to and may be replaced by the lower end position at the tip of the engaging portion 120.

The first center point P1 and the second center point P2 may not be arranged on the identical axis which is parallel to the insertion direction, and may be arranged on different axes which are parallel to the insertion direction. It is supposed that the angle between the axis AX10 and axis AX5 may be determined provided that the buckle 300 is being seen from left or right as shown in FIG. 9. The contact surface 238 may have a wider width in the left and right direction, enhancing the coupling strength of the buckle 300.

In the second exemplary embodiment shown in FIGS. 12 and 13, the inserted portion 220 may extend downward as extending away from the base 210. In other words, the inserted portion 220 may extend obliquely downward from the base 210. The second center point P2 may be positioned downward relative to the first center point P1 in the second exemplary embodiment either, thereby achieving similar effects as the first exemplary embodiment. The lower end position of the contact surface 238 of the engaged portion 230 may be positioned downward relative to the uppermost position at the lower surface of the base end 221 of the inserted portion 220 in the second exemplary embodiment either, thereby achieving similar effects as the first exemplary embodiment.

In the third exemplary embodiment shown in FIGS. 14 and 15, the lower surface of the inserted portion 220 is tilted downward as extending away from the base 210. The upper surface of the inserted portion 220 is not tilted as extending away from the base 210. In other words, the upper surface of the inserted portion 220 is substantially parallel to the insertion direction, and the lower surface of the inserted portion 220 is tilted downward as extending away from the base 210.

The thickness of the inserted portion 220 may increase as the inserted portion 220 extends away from the base 210, except for the tapered free end 222 of the inserted portion 220. The second center point P2 may be positioned downward relative to the first center point P1 in the third exemplary embodiment either, thereby achieving similar effects as the first exemplary embodiment. The lower end position of the contact surface 238 of the engaged portion 230 may be positioned downward relative to the uppermost position at the lower surface of the base end 221 of the inserted portion 220 in the third exemplary embodiment either, thereby achieving similar effects as the first exemplary embodiment.

In the fourth exemplary embodiment shown in FIGS. 16 and 17, the upper surface of the inserted portion 220 may be tilted downward as extending away from the base 210. The lower surface of the inserted portion 220 is not tilted as the lower surface extends away from the base 210. In other words, the lower surface of the inserted portion 220 is substantially parallel to the insertion direction, and the upper surface of the inserted portion 220 is tilted downward as extending away from the base 210.

The thickness of the inserted portion 220 may decrease as the inserted portion 220 extends away from the base 210. In the fourth exemplary embodiment, the first center point P1 is shifted upward in an amount of increased thickness of the base end 221 of the inserted portion 220, and the second center point P2 is positioned downward relative to the first center point P1. Even in this case, similar effects may be obtained as the first exemplary embodiment.

In the fifth exemplary embodiment shown in FIGS. 18 to 21, the engaged portion 230 provided at the free end 222 of the inserted portion 220 may project upward from the upper surface of the inserted portion 220. The inserted portion 220 may extend downward as extending away from the base 210. The second center point P2 may be positioned downward relative to the first center point P1 in the fifth exemplary embodiment either, thereby achieving similar effects as the first exemplary embodiment. The lower end position of the contact surface 238 of the engaged portion 230 may be positioned downward relative to the uppermost position at the lower surface of the base end 221 of the inserted portion 220 in the fifth exemplary embodiment either, thereby achieving similar effects as the first exemplary embodiment.

In the sixth exemplary embodiment shown in FIG. 22, the guide 240 may be configured to have a frame-like shape surrounding the inserted portion 220, and the engaged portion 230 provided at the inserted portion 220 may be configured by providing a through-hole at the inserted portion 220. If the second center point P2 is positioned downward relative to the first center point P1 and/or the lower end position of the contact surface 238 of the engaged portion 230 is positioned downward relative to the uppermost position at the lower surface of the base end 221 of the inserted portion 220, similar effects as the first exemplary embodiment may be obtained.

Descriptions have been made for each exemplary embodiment of seemingly distinct first to sixth exemplary embodiments. However, it is envisaged that any combination of embodiments will be possible for a skilled person. For example, the groove 225 in the first exemplary embodiment may be applied to each of the second to sixth exemplary embodiments, and further enhancement of the coupling strength of the buckle 300 may be expectedly achieved. Other manners of combinations between embodiments would be possible without any explicit descriptions.

In view of the above teachings, a skilled person could add various modifications to the respective embodiments. Reference numbers in Claims are just for a reference, and should not be used for the purpose of narrowly construing claims. The female part 100 may be named as a first member or socket, and the male part 200 may be named as a second member or a plug. Similarly, the base end may be named as a first end, and the free end may be named as a second end. In order to distinct elements, a first, a second, a third are utilized, which are not limiting with respect to the total number and order. The coupling strength may be named as an engaging strength.

REFERENCE NUMBER

100 Female part
110 Body
120 Engaging portion
200 Male part
210 Base
220 Inserted portion
221 Base end
222 Free end
230 Engaged portion
238 Contact surface
300 Buckle
P1 First center point
P2 Second center point

What is claimed is:

1. A buckle comprising:

a female part including a housing and an engaging portion provided at an inner surface of the housing;

a male part including a base and an inserted portion to be inserted into the housing of the female part, the inserted portion including a base end coupled to the base, a free end opposite to the base end, and an engaged portion to be engaged with the engaging portion, wherein the inserted portion, while having a thickness, extends from the base end to the free end, and is elastically pivotable around the base end as a pivot center to allow engagement and disengagement of the engaging and engaged portions, wherein when a force is applied to the male part for pulling the male part out of the housing, the engaged portion has a contact surface that is in planar contact with the engaging portion, wherein provided that downward indicates a direction along movement of the inserted portion from its initial posture toward its deformed posture during the engagement and disengagement of the engaging and engaged portions and upward indicates a direction along movement of the inserted portion recovering from the deformed posture toward the initial posture, (i) relative to a first center point at the center of the base end in a thickness direction of the inserted portion, a second center point at the center of the contact surface in said thickness direction is positioned downward; or (ii) relative to an uppermost position at a lower surface of the base end, a position at a lower end of the contact surface is positioned downward.

2. The buckle according to claim 1, wherein the lower surface of the base end of the inserted portion is provided with a groove.

3. The buckle according to claim 2, wherein a depth of the groove is equal to or less than a value calculated by multiplying the maximum thickness of a middle portion between the base end and the free end of the inserted portion and 5/6.

4. The buckle according to claim 1, wherein the engaged portion is projected in a width direction of the inserted portion which is perpendicular to an insertion direction of the inserted portion into the housing and the thickness direction of the inserted portion, and wherein a non-contact surface is provided between an upper surface and the contact surface of the engaged portion, the non-contact surface being not in contact with the engaging portion when the engaging and engaged portions are engaged.

5. The buckle according to claim 4, wherein the non-contact surface has a round rim between the upper surface and the contact surface of the engaged portion.

6. The buckle according to claim 1, wherein the female part includes a manipulation portion for releasing the engagement between the engaging and engaged portions, and a spring portion for moving the manipulation portion back to its initial position.

7. The buckle according to claim 1, wherein (a) the inserted portion extends downward as extending away from the base; or (b) an upper surface of the inserted portion is substantially parallel to an insertion direction of the inserted portion into the housing, and a lower surface of the inserted portion is tilted downward as extending away from the base; or (c) a lower surface of the inserted portion is substantially parallel to an insertion direction of the inserted portion into the housing, and an upper surface of the inserted portion is tilted downward as extending away from the base.

* * * * *